United States Patent [19]

Schmidlin

[11] Patent Number: 4,733,515

[45] Date of Patent: Mar. 29, 1988

[54] FIXING ARRANGEMENT FOR SHUTTER BLADES

[75] Inventor: Hans Schmidlin, Aesch, Switzerland

[73] Assignee: Eltreva AG, Aesch, Switzerland

[21] Appl. No.: 937,201

[22] PCT Filed: Mar. 22, 1986

[86] PCT No.: PCT/EP86/00173

§ 371 Date: Nov. 24, 1986

§ 102(e) Date: Nov. 24, 1986

[87] PCT Pub. No.: WO86/05573

PCT Pub. Date: Sep. 25, 1986

[30] Foreign Application Priority Data

Mar. 22, 1985 [DE] Fed. Rep. of Germany ..... 3510461

[51] Int. Cl.[4] ..... E06B 7/08

[52] U.S. Cl. ..... 52/473

[58] Field of Search ..... 52/663, 78, 473; 248/221.4, 245, 297.2

[56] References Cited

U.S. PATENT DOCUMENTS 4,306,661 12/1981 Allsop ..... 248/297.2 X

FOREIGN PATENT DOCUMENTS 1683286 5/1970 Fed. Rep. of Germany ..... 52/663
2910877 3/1979 Fed. Rep. of Germany ..... 52/663
2134604 12/1972 France ..... 52/663
2126707 3/1984 United Kingdom ..... 52/663

*Primary Examiner*—Carl D. Friedman
*Attorney, Agent, or Firm*—Schwartz, Jeffery, Schwaab, Mack, Blumenthal & Evans

[57] ABSTRACT

In a fastening arrangement for louver slats arranged below one another on a facade supporting structure, with supporting profiles which extend perpendicularly to the longitudinal direction of the louver and to which are fastened brackets which hold the slats in at least two places and which have a leg resting against the supporting profile and a leg projecting at an angle from the supporting profile, assembly without a tool becomes possible and a specific distance between the slats is set automatically if the supporting profile (4) is designed as a rail, in the longitudinal direction of which the brackets (2) are held displaceably by means of extensions (3) on the legs (5) resting against the supporting profile (4), and if the extensions (3) have, at the bottom end of the bracket (2), a receiving space (15), into which a filler piece (19) of the lower bracket (2) can be pushed with a clamping effect.

19 Claims, 4 Drawing Figures

Figure 1:
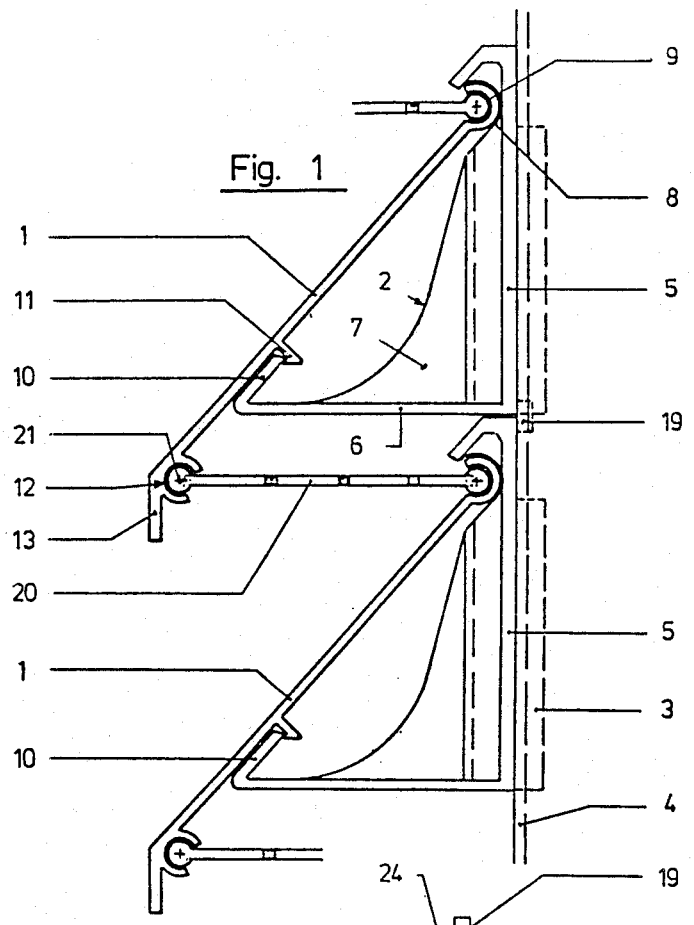

9
8
1
11
2
7
5
10
21
6
19
12
13
20
5
1
3
10
4

5
3
22
19
23
8
9
3
1

24
19
2

5
17
10
16

4
14
3
5
15
18
19
17
16
14

FIXING ARRANGEMENT FOR SHUTTER BLADES

The invention relates to a fastening arrangement for louver slats arranged below one another on a facade supporting structure, with supporting profiles extending perpendicularly relative to the longitudinal direction of the slats, designed as a rail and having a groove which extends in the longitudinal direction of the profiles and into which are pushed brackets which hold the slats in at least two places and each have a leg resting against the supporting profile and a leg projecting at an angle from the supporting profile, and which are retained in recesses in the supporting profiles by means of extensions on the leg resting against the supporting profile.

An embodiment of this type can be taken from German Offenlegungsschrift No. 2,910,877. This prior publication discloses various embodiments of ventilation gratings. The supporting profiles can be aluminum profiles which have a relatively shallow groove having a rectangular cross-section and extending in the longitudinal direction of the profiles. Brackets are pushed into this groove and, in the assembled state, can rest flush against one another. At the same time, a bracket can, by means of a sloping supporting face provided at its bottom end, be supported on a corresponding supporting face provided at the top end of the bracket located beneath it. That leg of each bracket which carries the extensions rests against the bottom of the said profile groove and carries mushroom-like pegs which are pressed into pre-drilled holes in the bottom of the said profile groove. In the assembled state, the mushroom-like pegs engage behind the said bore in the groove bottom. The bracket leg resting against the latter has, at its top end, a receiving chamber for a web of the slat. The free end of the projecting leg is equipped with a hook which is directed away from the said receiving chamber and which engages into a pocket provided on the underside of the slat. The slat continues downwards via the said projecting leg. The slats each have a groove at both their top end and their bottom end, and the orifices of the lower groove of the particular slat located above and of the upper groove of the particular slat located below are approximately at the same height and face one another. Edge portions of a grating can be inserted into the open grooves arranged at the same height.

In order to fasten a slat, at least two brackets arranged at a horizontal distance from one another are conventionally provided. At least two vertical supporting profiles consequently have to be assembled. Since these supporting profiles already have pre-drilled holes in the known embodiment, highly accurate alignment is necessary during assembly, to guarantee that the individual slats are aligned absolutely horizontally. At the same time, the distance between the uppermost slat and the surrounding masonry and the distance between the bottommost slat and the surrounding masonry have to be determined exactly even before the perforated supporting profiles are assembled. Another disadvantage of the above-described known construction is that the supporting profiles require additional machining by drilling, punching, milling or the like, in order to make the holes for the peg-like extensions of the brackets.

In contrast to this, the object on which the invention is based is to provide a fastening arrangement of the type described in the introduction, which makes much simpler assembly possible.

According to the invention, this object is achieved because the profile recesses of the extensions are formed by the said groove, in which the extensions are held so as to be displaceable, and because the extensions have, at the bottom end of the bracket, a receiving space, into which a filler piece of the bracket arranged below it can be inserted with a clamping effect.

In the fastening arrangement according to the invention, the brackets are inserted into the supporting profiles designed as rails and are displaceable along the supporting profile. Because the filler piece is pushed into the receiving space of the particular bracket located above, on the one hand the position of the bracket is fixed and on the other hand a uniform distance between the slats is obtained automatically and is determined by the length of the bracket leg resting against the rail, because the clamping connection between the brackets fixes the distance. Preferably, those legs of the brackets arranged below one another which rest against the rail butt against one another.

In a particularly preferred embodiment, the extension of the bracket is made resilient, so that it can be snapped into the rail. This can be achieved preferably if the extension is formed by two ribs which extend in the longitudinal direction of the resting leg and arranged at a distance from one another and which, each by means of a sloping outer face, form engagement projections for holding webs which point towards one another and which are located on the rails. The bracket can thus be snapped in at any point in the entire run of the rail, as a result of which it is displaceable in the longitudinal direction of the rail, but can no longer be pulled off from the rail.

In an actual embodiment, the filler piece projects beyond the top end of the resting leg. The ribs forming the extension terminate at the bottom end of the resting leg. When the brackets are pushed together, the filler piece of the lower bracket can penetrate into the gap between the legs of the upper bracket. The receiving space for the filler piece is therefore formed by the gap between the two legs. In order to obtain a specific end position for the brackets when they are pushed together, it is advantageous if the top end of the resting leg has a bearing face for bearing on the bottom end of the resting leg of the bracket located above. It is also advantageous if the clamping connection between the filler piece and the receiving space of the bracket located above is in the form of a snap engagement.

The fastening system according to the invention with brackets adjacent to one another without a gap does not allow the hitherto conventional use of slats which the brackets engage over at the top and bottom. So that no bracket parts become visible on the outside, in a preferred embodiment the resting leg of the bracket has, at its top end, a receiving chamber for a web of the slat, the free end of the projecting web being equipped with a hook which is directed towards the receiving chamber and which engages behind a web provided with an engagement projection and located on the underside of the slat. The slat continues downwards via the projecting leg. This means that the slat continued downwards covers the upper part of the receiving chamber of the bracket located below, which cannot be covered by the particular slat held in the respective bracket. The slat is on the one hand held in the bracket in the receiving chamber and on the other hand fastened as a result of the engaging connection between the fastening hook and the engagement web. At the same time, the receiving chamber is designed so that, in the angular position of the slat predetermined by the snap engagement, the slat cannot escape from the receiving chamber. To remove the slat from the receiving chamber, it is necessary to lift it into a position approximately perpendicular to the resting leg of the bracket.

To prevent the slats from falling out when the brackets are assembled, should the engaging connection come loose accidentally and the slat be lifted into the horizontal position by wind suction or the like, the bottom end of the resting leg of the bracket preferably has attached to it an angle directed downwards, the downward-directed angled part of which is located in front of the orifice of the receiving chamber of the lower bracket when the latter is clamped to the upper bracket. Thus, when the brackets are pushed together the receiving space is consequently closed by the angle part of the upper bracket, so that the slat is prevented from falling out of the receiving space even under adverse conditions.

The new method of assembling the slats makes it possible at the same time to fasten further elements, such as, for example, a grating, if the slats have, at their top and bottom ends, a web in the form of a groove with a cross-section somewhat more than semi-circular, the orifices of the lower groove of the upper slat and of the upper groove of the lower slat being approximately at the same height and facing one another. The open grooves of the slats can be used to receive further elements. Preferably, the open grooves arranged at the same height hold a ventilation grating by receiving the thickened edge portions of the grating. If the edge portions are made of an elastic material, a secure snap connection can be made.

Figure 4:
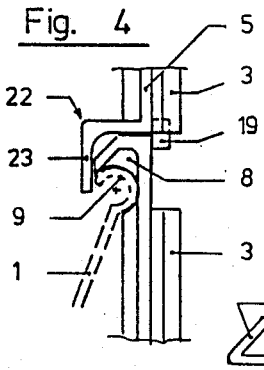
Figure 3:
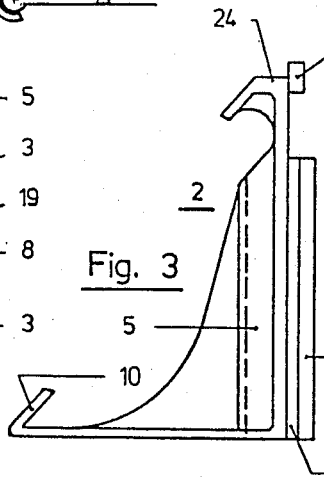
Figure 2:
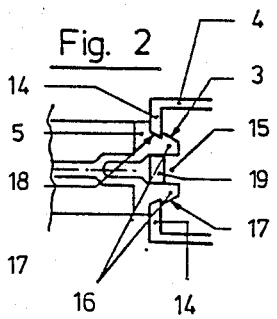

The invention will be explained in detail below with reference to exemplary embodiments illustrated in the drawing. In the drawing:

FIG. 1 shows a fastening arrangement with two brackets and slats arranged below one another, FIG. 2 shows, in a planned view, a detailed representation of the extension of the brackets and that part of the rail of the supporting profile which holds the extension, FIG. 3 shows a side view of a bracket as an individual part, FIG. 4 shows a detailed representation of an upper bracket equipped with a retaining angle for the receiving chamber of the lower bracket.

FIG. 1 shows two slats 1 which are arranged below one another and which are fastened to two brackets 2 by being inserted and snapped on. The brackets are equipped with extensions 3, by means of which they are displaceable in a supporting profile 4 designed as a rail in the longitudinal direction of the latter, that is to say vertically in the illustration in FIG. 1.

The brackets 2 comprise essentially a leg 5 resting against the supporting profile 4 and a leg 6 projecting perpendicularly from the supporting profile 4. To increase the stability, the two legs 5, 6 are connected to one another by means of a middle part 7. The resting leg 5 has, at its top end, a receiving chamber 8 for a web 9 designed as an open groove and located at the top end of the slat 1. The receiving chamber 8 opens obliquely downwards from the top end, that is to say approximately in the direction of the main body of the slat 1 in the assembled state. The free end of the projecting leg 6 of the bracket 2 is bent up so as to point obliquely upwards towards the receiving chamber 8 and forms a fastening hook 10. The slat 1 has, on its underside, a rib 11 extending in the longitudinal direction and provided with an engagement projection. The slat is mounted on the bracket by inserting the web 9 into the receiving chamber 8, with the slat 1 approximately horizontal, and by subsequently swinging the slat down until the engagement projection of the web 11 snaps behind the fastening hook 10 of the projecting leg 6 of the bracket 2. In the assembled state, the slat 1 continues below the projecting leg 6 of the bracket and, when mounted, has a groove 12 open towards the supporting profile 4 and likewise of circular cross-section. The slat terminates on its underside in a drip edge 13.

FIG. 2 illustrates the design of the extension 3 of the bracket 2 and the guidance of the bracket 2 in the supporting profile 4 designed as a rail. The supporting profile 4 is designed as a rectangular profile provided with a longitudinal slot, that is to say it has two holding webs 14 pointing towards one another in order to limit the slot. The extension 3 of the bracket 2 is formed by two ribs 16 which extend in the longitudinal direction of the resting leg 5 and form a gap 15 between them and which, each by means of a sloping outer face 17, constitute an engagement projection for the holding webs 14.

The distance between the outer faces at the front end of the ribs 16 is less than the distance between the holding webs 14. By attaching the ribs 16 between the holding webs 14 and exerting pressure in the direction of the supporting profile 4, the somewhat elastic ribs 16 are pressed towards one another, so that the webs can engage behind the engagement projections formed by the ribs 16. To assist the snap-in action, the end faces of the holding webs 14 are likewise designed as slopes 18.

A filler piece 19 of the width of the gap 15 between the two ribs 16 is provided at the upper end of the resting web 5 and so as to project beyond this at the top. When the two brackets 2 are pushed together, the filler piece 19, which can be narrowed somewhat towards the top for this purpose, penetrates into the gap 15. As a result, the ribs 16 are pressed outwards somewhat and, together with the holding webs 14 of the supporting profile 4, make a non-positive connection which now prevents the bracket 2 from moving in a longitudinal direction of the supporting profile 4. Consequently, when the filler piece 19 of the lower bracket 2 is pushed into the gap 15 between the ribs 16 of the upper bracket 2, the upper bracket 2 is locked on the supporting rail 4.

As illustrated in FIG. 1, the upper groove 9 of the lower bracket 2 and the lower groove 12 of the upper bracket 2 are at the same height and their orifices face one another. The grooves 9, 12 are therefore suitable for receiving additional elements, such as ventilation gratings 20, meshes or the like, in the slat apertures. FIG. 1 shows a ventilation grating 20 which is pressed into the grooves 9, 12 by means of thickened edge portions 21''.

FIG. 4 shows a modified embodiment of the bracket 2 in which the bottom end of the resting leg has attached to it an angle piece 22, a downward-projecting angle part 23 of which closes off the orifice of the receiving chamber 8 of the lower bracket 2 to such an extent that the web 9 of the slat 1 can no longer be removed from the receiving chamber 8 when the two brackets are connected to one another via the filler piece 19.

To guarantee a specific assembly position of the brackets 2 connected to one another, the latter have, at their top ends, a plane bearing face 24 which, in the assembled state, rests against the projecting leg 6 of the particular bracket located above and which forms a stop for the assembly operation. This assembly operation can be further assisted if a snap engagement is obtained when the filler piece 19 is pushed into the gap 15 in the upper bracket 2, so that the complete insertion of the lower bracket into the upper bracket can also be heard by the clicking of the engagement means.

It is evident that the fastening arrangement according to the invention makes it possible to achieve extremely simple assembly without the need for screw connections and, because the brackets 2 are arranged adjacent to one another without a gap, always guarantees a uniform distance between the slats 1.

I claim:

1. A bracket for use in supporting a louver slat on a facade, the facade having a groove extending perpendicularly to the louver slat for receiving the bracket, comprising:

a first leg;

a second leg connected to the first leg and projecting at an angle from the first leg, the first and second legs being adapted to hold a portion of the louver slat;

a filler piece projecting beyond one end of the first leg; and means for infinitely adjusting the bracket along the groove comprising a pair of spaced members attached to the first leg and adapted to be received in the groove, the spaced members being adapted to be displaced away from one another when the filler piece of a contiguous bracket is inserted therebetween, whereby the spaced members, when displaced, compressively engage the sides of the groove and thereby hold the bracket at a desired location along the groove.

2. A bracket as claimed in claim 1, wherein the spaced members are dimensioned to resiliently snap into the groove.

3. A bracket as claimed in claim 1, wherein each spaced member comprises a projection defining a shoulder for engaging the lip of a rail positioned within the groove.

4. A bracket as claimed in claim 1, wherein the first leg, comprises, at the end at which the filler piece is attached, a bearing face for bearing on the bottom of a contiguous bracket.

5. A bracket as claimed in claim 1, wherein the first leg comprises a receiving chamber adjacent the end at which the filler piece is attached and the second leg comprises a hook at its free end, the receiving chamber and the hook being adapted to engage projections on the louver slat.

6. A bracket as claimed in claim 5, wherein the second leg comprises a projecting angle part adapted to project downwardly beyond the receiving chamber of a contiguous bracket when the bracket and the contiguous bracket abut one another.

7. A fastening arrangement for supporting a louver slat on a facade, the facade having at least two parallel grooves extending perpendicularly to the louver slat, comprising:

a plurality of brackets, each bracket for supporting a portion of the louver slat and being adapted to be received in and selectively positioned along a respective groove, and each bracket comprising:

a first leg;

a second leg connected to the first leg and projecting at an angle from the first leg, the first and second legs being adapted to hold a portion of the louver slat;

a filler piece projecting beyond one end of the first leg; and means for infinitely adjusting the bracket along the the groove comprisng a pair of spaced members attached to the first leg and adapted to be received in the groove, the spaced members being adapted to be displaced away from one another when the filler piece of a contiguous bracket is inserted therebetween, whereby the spaced members, when displaced, compressively engage the sides of the groove and thereby hold the bracket at a desired location along the groove.

8. A fastening arrangement as claimed in claim 7, wherein each spaced members is dimensioned to resiliently snap into a respective groove.

9. A fastening arrangement as claimed in claim 7, wherein each spaced member comprises a projection defining a shoulder for engaging the lip of a rail positioned within each groove.

10. A fastening arrangement as claimed in claim 7, wherein each first leg comprises, at the end at which the filler piece is atttached, a bearing face for bearing on the bottom of a contiguous bracket.

11. A fastening arrangement as claimed in claim 7, wherein each first leg comprises a receiving chamber adjacent the end at which the filler piece is attached and each second leg comprises a hook at its free end, the respective receiving chamber and the hook of each bracket being adapted to engage projections on the louver slat.

12. A fastening arrangement as claimed in claim 11, wherein each second leg comprises a projecting angle part adapted to project downwardly beyond the receiving chamber of a contiguous bracket when the bracket and the contiguous bracket abut one another.

13. A louver slat assembly for a facade, the facade having at least two parallel grooves, comprising:

a plurality of louver slats adapted to be mounted to the facade perpendicular to the direction of the grooves;

a plurality of brackets for mounting the louver slats to the facade, each bracket for supporting a portion of a respective louver slat and being adapted to be received in and selectively positioned along a respective groove and each bracket comprising:

a first leg;

a second leg connected to the first leg and projecting at an angle from the first leg, the first and second legs being adapted to hold a portion of the louver slat;

a filler piece projecting beyond one end of the first leg; and means for infinitely adjusting the bracket along the groove comprising a pair of spaced members attached to the first leg and adapted to be received in the groove, the spaced members being adapted to be displaced away from one another when the filler piece of a contiguous bracket is inserted therebetween, whereby the spaced members, when displaced, compressively engage the sides of the groove and thereby hold the bracket at a desired location along the groove.

14. A louver slat assembly as claimed in claim 13, wherein each spaced member is resilient.

15. A louver slat assembly as claimed in claim 13, wherein each spaced member comprises a projection adapted to engage a rail in the groove.

16. . A louver slat assembly as claimed in claim 13, wherein each first leg comprises, at the end at which the filler piece is attached, a bearing face for bearing on the bottom of a contiguous bracket.

17. A louver slat assembly as claimed in claim 13, wherein each first leg comprises a receiving chamber adjacent the end at which the filler piece is attached, each second leg comprises a hook adjacent the free end of the leg, and each respective louver slat comprises a pair of webs which engage with the respective hook and receiving chamber of a bracket so as to connect the louver slat to the bracket.

18. A louver slat assembly as claimed in claim 17, wherein second leg of each bracket comprises a projection adapted to project over a respective receiving chamber of a contiguous bracket when the bracket and the contiguous bracket about one another.

19. A louver slat assembly as claimed in claim 13, wherein adjacent louver slats are connected to one another by a grating extending from the top of one louver slat to the base of the adjacent louver slat.

* * * * *